US008376780B2

(12) United States Patent
Dorscht et al.

(10) Patent No.: US 8,376,780 B2
(45) Date of Patent: Feb. 19, 2013

(54) INDUSTRIAL PLUG CONNECTOR

(75) Inventors: Markus Dorscht, Strullendorf-Geisfeld (DE); Dieter Markl, Zeil (DE)

(73) Assignee: Wieland Electric GmbH, Bamberg (DE)

( * ) Notice: Subject to any disclaimer, the term of this patent is extended or adjusted under 35 U.S.C. 154(b) by 0 days.

(21) Appl. No.: 12/854,586

(22) Filed: Aug. 11, 2010

(65) Prior Publication Data

US 2011/0053417 A1 Mar. 3, 2011

(30) Foreign Application Priority Data

Aug. 26, 2009 (DE) ..... 20 2009 011 563 U
Feb. 25, 2010 (DE) ..... 20 2010 002 782 U

(51) Int. Cl.
*H01R 9/03* (2006.01)

(52) U.S. Cl. ..... 439/607.53

(58) Field of Classification Search ..... 439/607.53, 439/607.41, 660
See application file for complete search history.

(56) References Cited

U.S. PATENT DOCUMENTS

| | | | | | |
|---|---|---|---|---|---|
| 3,173,734 | A | * | 3/1965 | Hartwell | 439/291 |
| 3,345,604 | A | * | 10/1967 | Henschen et al. | 439/310 |
| 3,535,676 | A | * | 10/1970 | Schultz, Sr. | 439/90 |
| 3,539,973 | A | * | 11/1970 | Wright et al. | 439/90 |
| 3,549,990 | A | * | 12/1970 | Hochheiser | 323/345 |
| 4,464,003 | A | * | 8/1984 | Goodman et al. | 439/404 |
| 4,767,350 | A | * | 8/1988 | Cooper et al. | 439/271 |
| 5,030,114 | A | | 7/1991 | Carey et al. | |
| 5,618,202 | A | | 4/1997 | Okuyama et al. | |
| 5,823,833 | A | * | 10/1998 | Castaldo | 439/851 |
| 6,004,163 | A | * | 12/1999 | Behling et al. | 439/701 |
| 6,095,853 | A | * | 8/2000 | Huang et al. | 439/541.5 |
| 6,129,586 | A | | 10/2000 | Bellemon | |
| 6,257,929 | B1 | | 7/2001 | Wang | |
| 6,582,244 | B2 | * | 6/2003 | Fogg et al. | 439/362 |
| 6,582,255 | B2 | * | 6/2003 | Peterson et al. | 439/701 |
| 6,981,895 | B2 | * | 1/2006 | Potega | 439/578 |
| 7,134,899 | B1 | | 11/2006 | Huang | |
| 7,303,438 | B2 | * | 12/2007 | Dawiedczyk et al. | 439/607.53 |
| 7,320,613 | B1 | * | 1/2008 | Ratzlaff | 439/345 |
| 7,585,189 | B2 | * | 9/2009 | Wu et al. | 439/660 |
| 7,713,085 | B2 | * | 5/2010 | Wu et al. | 439/541.5 |
| 7,726,982 | B2 | * | 6/2010 | Ngo | 439/79 |
| 7,857,663 | B2 | * | 12/2010 | Chantrell et al. | 439/607.41 |
| 7,878,855 | B2 | * | 2/2011 | Li | 439/607.45 |
| 2002/0146926 | A1 | * | 10/2002 | Fogg et al. | 439/362 |
| 2002/0146931 | A1 | * | 10/2002 | Richmond et al. | 439/488 |
| 2002/0146938 | A1 | * | 10/2002 | Wiebking et al. | 439/660 |
| 2003/0036313 | A1 | * | 2/2003 | Bollin et al. | 439/638 |
| 2003/0162441 | A1 | * | 8/2003 | Nelson et al. | 439/608 |
| 2008/0132111 | A1 | * | 6/2008 | Wu et al. | 439/491 |
| 2009/0011645 | A1 | * | 1/2009 | Laurx et al. | 439/608 |
| 2009/0280694 | A1 | * | 11/2009 | Zhuang et al. | 439/668 |
| 2010/0184331 | A1 | * | 7/2010 | Chantrell et al. | 439/607.41 |

FOREIGN PATENT DOCUMENTS

JP 2000048912 A 2/2000

* cited by examiner

*Primary Examiner* — Amy Cohen Johnson
*Assistant Examiner* — Vladimir Imas
(74) *Attorney, Agent, or Firm* — Laurence A. Greenberg; Werner H. Stemer; Ralph E. Locher

(57) ABSTRACT

An industrial plug connector includes a base part and a plug part which can be mated with the base part. The base part and the plug part each have a contact insert and a metallic housing. A first metallic frame sheet is disposed on the base part and a second metallic frame sheet is disposed on the plug part, in such a way that the two frame sheets at least partially overlap, forming a shield attenuation, when the industrial plug connector is in a mated state.

12 Claims, 5 Drawing Sheets

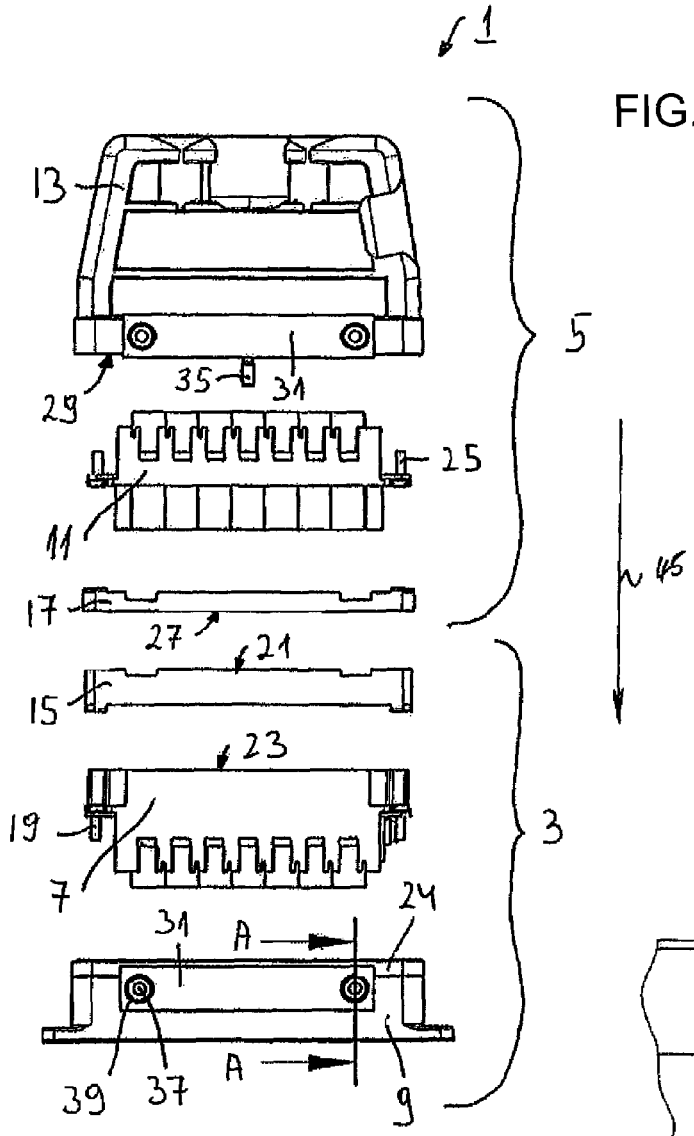
FIG. 2
FIG. 3
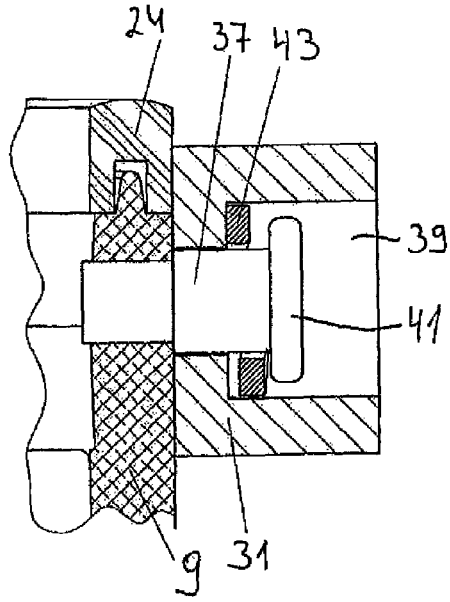

INDUSTRIAL PLUG CONNECTOR

CROSS-REFERENCE TO RELATED APPLICATION

This application claims the priority, under 35 U.S.C. §119, of German Patent Applications DE 20 2009 011 563.1, filed Aug. 26, 2009, and DE 20 2010 002 782.9, filed Feb. 25, 2010; the prior applications are herewith incorporated by reference in their entirety.

BACKGROUND OF THE INVENTION

Field of the Invention

The invention relates to an industrial plug connector, including a base part and a plug part which can be mated with the base part.

Heavy industrial plug connectors, which are referred to herein simply as plug connectors, are constructed specifically for use in particularly severe environments. In general, industrial plug connectors such as these include a base part and a plug part for mating with the base part. Both the base part and the plug part have a contact insert, which is accommodated in a normally metallic housing. In particular, the housing is a die-cast part and offers a contact attachment reliable protection against environmental influences. Industrial plug connectors are used, for example, in the automobile industry, in machine and installation construction, for conveyor installations, and in measurement, control and regulation technology and, depending on the application, may have contact inserts with, for example, 6 to 92 poles.

When industrial plug connectors are being used, the radiation which acts in the plug connectors and originates from the plug connectors must be taken into account since it could adversely affect the functionality of connected systems or systems surrounding them. In this case, a fundamental distinction is drawn between electrical and magnetic fields.

The shielding of the system is described by the characteristic variables "shield attenuation" and "coupling impedance." The shield attenuation $a_S$ [dB] is defined as the logarithmic ratio of the power fed into the system to the power radiated from the system. The coupling impedance $Z_K$ represents a length-related variable, which is quoted in mΩ/m. This impedance is represented as the ratio of the longitudinal voltage which is indicated in the environment to the current in the interior of the system per unit length.

These variables are determined on the basis of the IEC Standard 60603-7-3 (2008-01). $Z_K$ can be calculated from the determined measured values for the shield attenuation, with the aid of this Standard.

SUMMARY OF THE INVENTION

It is accordingly an object of the invention to provide an industrial plug connector, which overcomes the hereinaforementioned disadvantages of the heretofore-known devices of this general type and which has a particularly simply produced shielding.

With the foregoing and other objects in view there is provided, in accordance with the invention, an industrial plug connector, comprising a base part and a plug part configured to be mated with the base part. The base part and the plug part each having a respective contact insert and a respective metallic housing. A first metallic frame sheet is disposed on the base part and a second metallic frame sheet is disposed on the plug part. The frame sheets are at least partially mutually overlapped in a mated state.

By way of example, the industrial plug connector is a plug connector constructed according to the IEC 60603-7-3 Standard.

The invention is based on the concept that an industrial plug connector shield, which can be produced particularly easily, is provided by a two-part metallic frame, with a first frame sheet being disposed on the base part and a second frame sheet being disposed on the plug part. The frame sheets are of such a size and are positioned in such a way, that they at least partially overlap when the industrial plug connector is in the mated state, and therefore form a Faraday cage, which increases the absorption, in particular of magnetic radiation. When the base part and the plug part are in the mated state, the frame sheets engage in one another, as a result of which they lie on one another and form a closed frame. In this case, "partially overlapping" means that, when the plug connector is in the mated state, a closed and uninterrupted frame is formed simply by the frame sheets engaging in one another. The frame surrounds the contact area of the contact inserts, without any need for the two frame sheets to overlap over a large area. In particular, each of the frame sheets is coupled to the corresponding contact insert, as a result of which there is no need to modify the metallic housing. One major advantage of this embodiment is therefore that the two-part frame can also be retrospectively integrated in existing industrial plug connectors.

In accordance with another feature of the invention, the frame sheets are expediently formed from a low-impedance, conductive material. In order to imitate the formation of a standard, integral frame, the frame sheets are advantageously manufactured from the same material, for example from galvanized steel sheet, copper or brass.

In accordance with a further feature of the invention, a particularly simple and reliable connection is produced between the frame sheets and the contact inserts by virtue of the frame sheets preferably being screwed to the respective contact insert. The frame sheets can also be coupled to the contact inserts, or alternatively to the housing, by some other force-locking, form-locking or material-locking or integral connection. A force-locking connection is one which connects two elements together by force external to the elements, as opposed to a form-locking connection which is provided by the shapes of the elements themselves.

In accordance with an added feature of the invention, the first frame sheet on the base part projects out of the metallic housing of the base part and is aligned with the contact insert. In addition to this, the second frame sheet is preferably disposed within the housing of the plug part, and is aligned with it. When the industrial plug connector is in the mated state, the two housings rest on one another, as a result of which the housing of the plug part surrounds the projecting part of the contact insert of the base part, and therefore also the first frame sheet. Since the second frame sheet is aligned with the housing of the plug part, this ensures that the two frame sheets engage in one another.

In accordance with an additional feature of the invention, a low impedance between the upper part and lower part is ensured by a large-area screw connection. Preferably, therefore, a strip is mounted on each of the two sides on the base part and on the plug part, and the strips have corresponding holes for holding a screw through them, for screwing the base part to the plug part. In order to ensure a secure attachment, the strips are expediently riveted to the base part and to the plug part. In order to ensure that the strips in this case rest flush on the housing, a spring element is preferably provided between a rivet head and the strip. The spring element ensures that the strip is pressed firmly against the housing in the area of the respective rivet.

In accordance with a concomitant feature of the invention, a frame sheet is provided in the area of the junction between the housing wall and the base part of the industrial plug connector. This frame sheet has a collar which passes through the through-opening in the housing wall to the industrial plug connector. This collar rests on the housing at the base part when in the final assembled state. This results in an electrical contact between the interior of the housing, which is surrounded by the housing wall, and the industrial plug connector. This therefore also results in effective EMC protection for the junction between the housing and, for example, a switchgear cabinet and the industrial plug connector.

Other features which are considered as characteristic for the invention are set forth in the appended claims.

Although the invention is illustrated and described herein as embodied in an industrial plug connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 2 is an exploded, front-elevational view of the components of the industrial plug connector shown in FIG. 1;

FIG. 3 is an enlarged, fragmentary, cross-sectional view taken along a line A-A of FIG. 2, in the direction of the arrows;

DETAILED DESCRIPTION OF THE INVENTION

Figure 1:
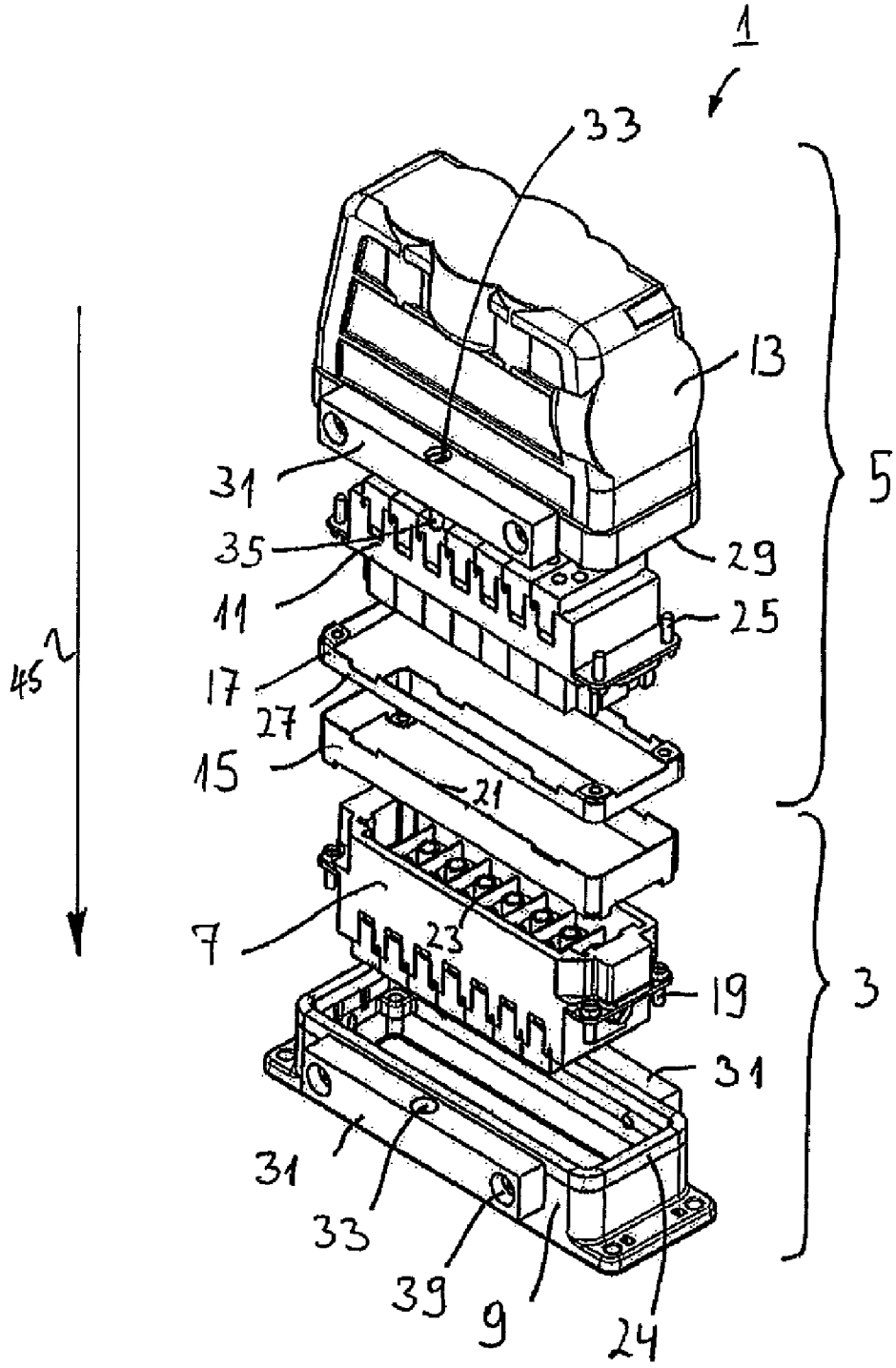
FIG. 1 is a diagrammatic, exploded, perspective view of components of an industrial plug connector.

Referring now in detail to the figures of the drawings which show an exemplary embodiment of the invention, in which mutually corresponding parts having the same effect are provided with the same reference symbols and first, particularly, to FIGS. 1 and 2 thereof, there is seen an industrial plug connector 1 which substantially has a base part 3 and a plug part 5. The base part 3 includes a multipole contact insert 7 which is disposed in a housing 9 when in an assembled state. The plug part 5 itself includes a further contact insert 11, which is constructed to be complementary to the contact insert 7 of the base part 3 and is accommodated in a further housing 13.

The industrial plug connector 1 also includes EMC (electromagnetic compatibility) measures for shielding attenuation of the metallic housing 9, 13. The EMC measures are in the form of first and second metallic frame sheets 15, 17, which are firmly connected to the respective contact inserts 7, 11 when the base part 3 and the plug part 5 are in a mated state. The first frame sheet 15 is plugged onto the contact insert 7 and is screwed to it through the use of screws 19. The dimensions of the first frame sheet 15 are such that its outer edge 21 is aligned with an outer edge 23 of the contact insert 7 when the base part 3 is in the assembled state. Since the contact insert 7 partially projects out of the housing 9 of the base part 3, the frame sheet 15 likewise projects out of the housing 9. In addition, a seal 24 is provided around one edge of the base part 3 and ensures that there is no air gap at a contact point between the base part 3 and the plug part 5 when the industrial plug connector 1 is in the mated state.

In a similar manner, the second metallic frame sheet 17 is plugged onto the contact insert 11 of the plug part 5, and is screwed to it through the use of screws 25. The difference between the frame sheets 15 and 17 is that the second frame sheet 17 has a shorter height, as a result of which the frame sheet 17 does not completely cover that part of the contact insert 11 which projects beyond the housing 13 of the plug part 5. The height of the second frame sheet 17 is chosen in such a way that, when the plug part 5 is in the assembled state, the second frame sheet 17 is disposed within the housing 13, and an outer edge 27 of the frame sheet 17 is aligned with an outer edge 29 of the housing 13.

The two frame sheets 15, 17 therefore represent a type of extension of the respective housing 9, 13 and their dimensions are such that they overlap when the industrial plug connector 1 is in the mated state. There is no need in this case for a large-area overlap of the two frame sheets 15, 17, but instead they rest on one another only over a portion of their height, in particular over less than half their height, thus forming an uninterrupted frame which surrounds the contact area of the contact inserts 7, 11. The frame in this case acts as a Faraday cage which, in particular, absorbs magnetic radiation at a low frequency, and therefore forms a shield for the industrial plug connector 1.

When the industrial plug connector 1 is in the mated state, the base part 3 and the plug part 5 are firmly connected to one another, as a result of which the contact between the two contact inserts 7 and 11 does not become detached. For this purpose, a strip 31 is riveted on each of the two sides both to the base part 3 and to the plug part 5. The strips 31 have corresponding holes 33, which extend in the mating direction of the industrial plug connector 1, for holding screws 35 which pass through them. When the industrial plug connector 1 is in the mated state, the base part 3 is screwed to the plug part 5 by the screws 35 which pass through them. Furthermore, further rivet holes 39 are provided for rivets 37, at right angles to the holes 33.

The attachment of a strip 31 to the base part 3 through a rivet 37 can be seen from the section through the plane A-A shown in FIG. 2, which is illustrated in an enlarged manner in FIG. 3. In order to fix the strips 31 in such a way that they rest flush on the housing 9, a spring element 43 in the form of a lock washer is disposed between a rivet head 41 and the strip 31, in this exemplary embodiment between the rivet head 41 and a base of the rivet hole 39.

Figure 4:
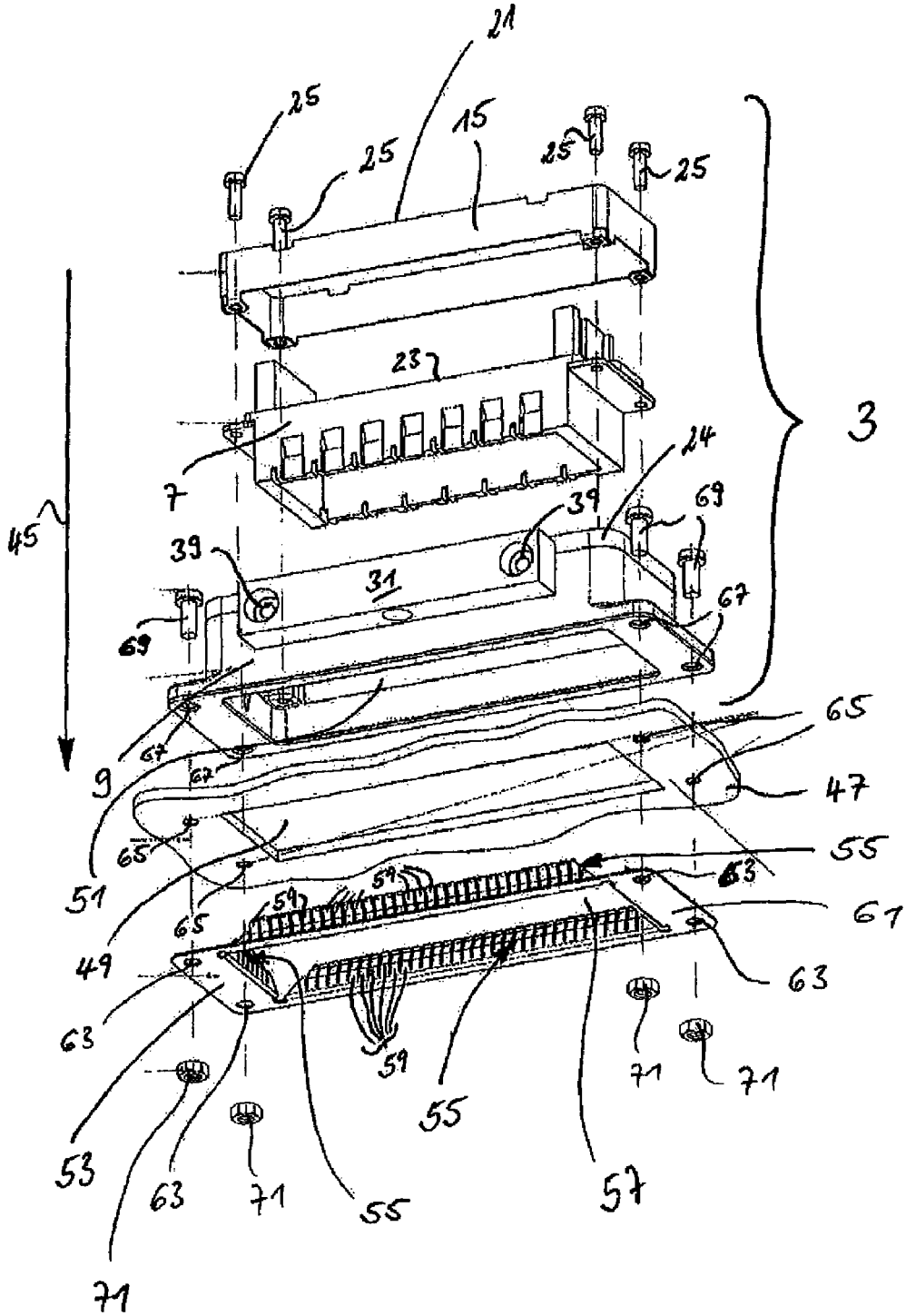
FIG. 4 is a fragmentary, exploded, perspective view of a base part which can be fixed to a housing wall.

FIG. 4 shows an exploded illustration of only a base part 3 of an industrial plug connector 1 according to the invention. A housing wall 47 is shown under the base part 3 in a mating direction 45. The plug part 5 is plugged onto the base part 3 in the mating direction 45 for mating of the industrial plug connector 1. The housing wall 47 is illustrated in FIG. 4 only as a section cut from an entire housing wall 47. The housing wall 47 may be a component of a housing or of a switchgear cabinet, or the like.

The housing wall 47 is itself interrupted by a through-opening 49. The through-opening 49 is used for contacts, line elements or the like to pass through. In the exemplary embodiment, the through-opening 49 is used for a line to connect the contact part 7 of the base part 3 to appliances, which are not illustrated in FIG. 4, within the housing which is bounded by the housing wall 47.

In the example shown in FIG. 4, the through-opening 49 is rectangular. An installation area surrounded by the housing 9 of the base part 3, for the contact insert 7 of the base part 3, also has a rectangular cross section. An installation area opening 51 in the housing 9 of the base part 3 is consequently likewise rectangular. In the exemplary embodiment shown in FIG. 4, the through-opening 49 and the installation area opening 51 are of the same size and are aligned with one another when in the final assembled sate. The through-opening 49 and the installation area opening 51 are therefore substantially coincident when in the final assembled state.

When in the final assembled state, a collar 55 on a frame sheet 53 is passed through both the through-opening 49 and the installation area opening 51 from the interior of the housing, which is surrounded by the housing wall 47, in the opposite direction to the mating direction 45. When in the final assembled state, the collar 55 in this case rests on the inner wall of the installation area in the housing 9 of the base part 3.

The collar 55 flanks a frame opening 57 in the frame sheet 53 circumferentially. In this case, the collar 55 is formed from a multiplicity of teeth 59 which are disposed alongside one another and are at the same time sprung. In this case, the collar 55 may be in the form of a sprung strip, in which a multiplicity of vertical slots are incorporated to form the teeth 59.

When in the final assembled state, the teeth 59 of the collar 55 rest by spring pressure on the inside of the housing walls of the housing 9 of the base part 3. This results in an electrical contact between the housing wall 47 and the housing 9 of the base part 3. In this case, the teeth 59 act like contact laminates. That area of the interface between the housing wall 47 and the base part 3 which initially has no EMC protection or EMC shielding, is likewise provided with effective EMC protection by this measure.

A circumferential mounting flange 61 is formed on the frame sheet 53. Holes 63 pass through the mounting flange 61 and are aligned with through-holes 65, which pass through the housing wall 47, and with attachment holes 67 which are provided in the housing 9 of the base part 3. When in the final assembled state, threaded bolts 69 pass in the mating direction 45 through the attachment holes 67, the through-holes 65 and the holes 63 in the frame sheet 53. Nuts 71 are screwed to the threaded bolts 69 themselves. The screw connection of the nuts 71 to the threaded bolts 69 results in the base part 3 of the industrial plug connector 1 being fixed on the housing wall 47, at the same time fixing the frame sheet 53 on the housing wall 47.

Figure 5:
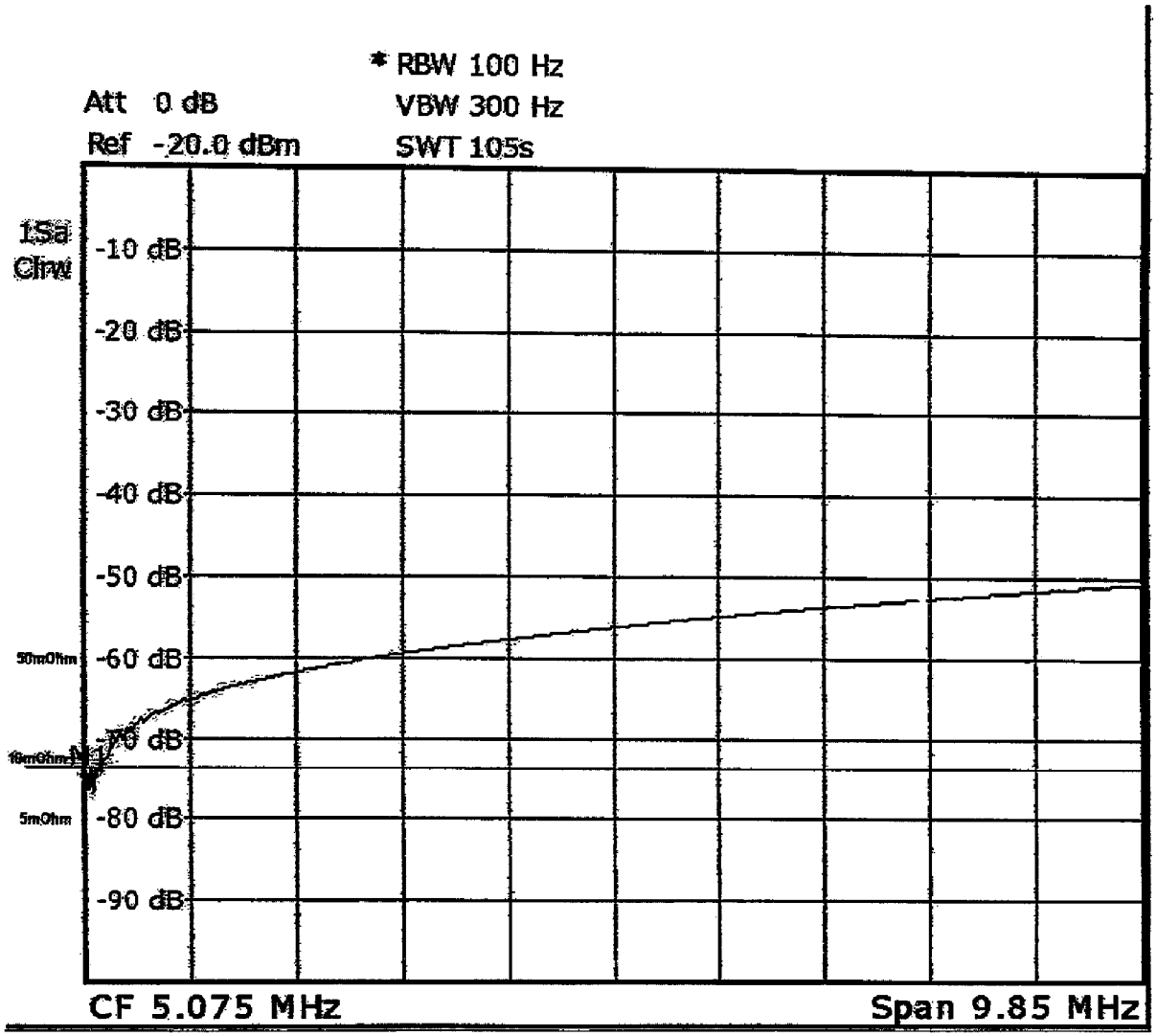
FIG. 5 is a graph showing measurement results for determining coupling impedance of a commercially available plug connector.
Figure 6:
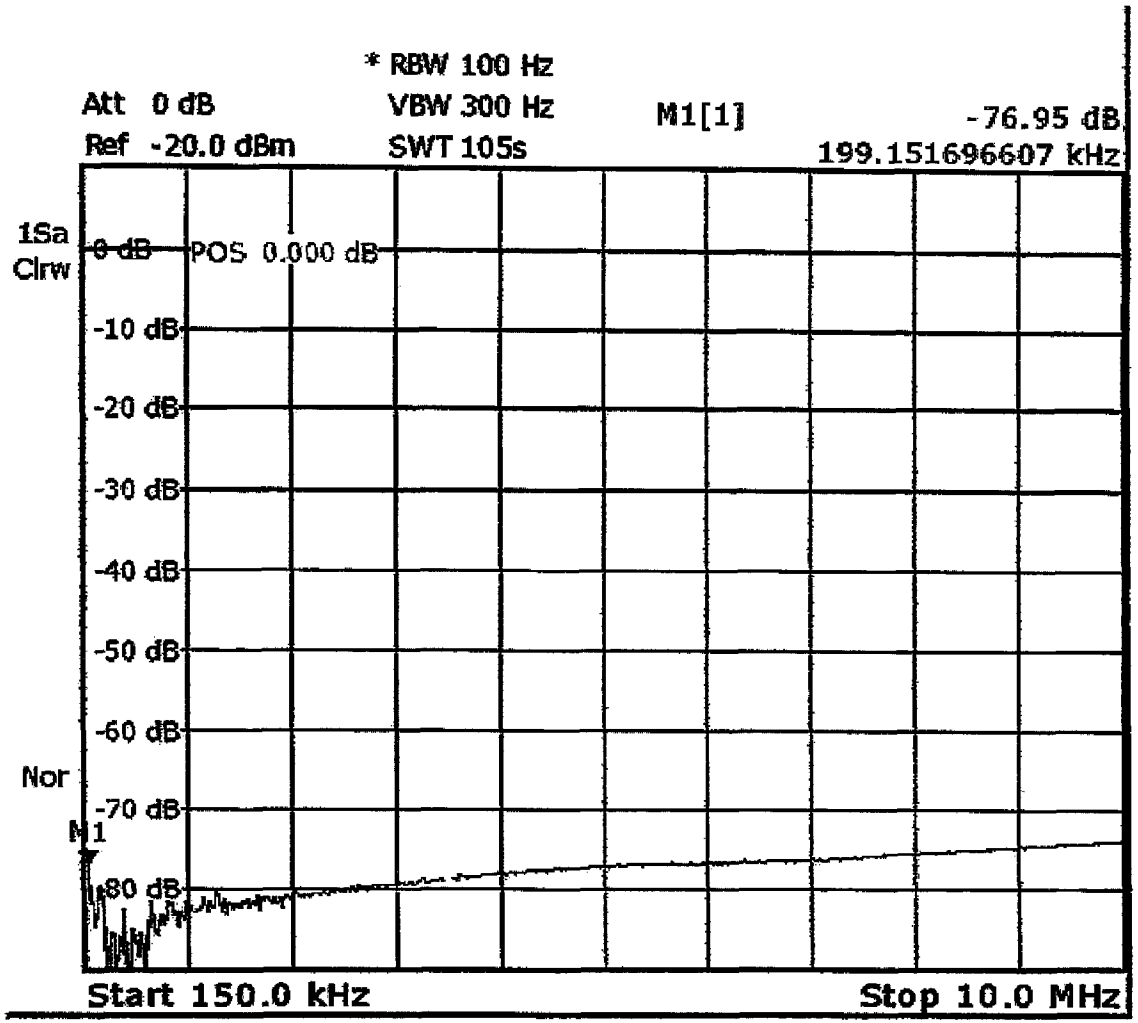
FIG. 6 is a graph showing measurement results for determining coupling impedance of a plug connector having a two-part metallic frame.

The efficiency of the EMC frame has been tested and has been compared with a commercially available REVOS® plug connector from the Wieland Company. During the measurements, the coupling impedance of the plug connector was plotted over a frequency range of from 150 kHz to 10 MHz. The measurements showed that the plug connector known from the prior art achieved a shielding attenuation value of about −50 dB at a test frequency of 10 MHz (see FIG. 5). This corresponds to a coupling impedance or a transfer impedance of about 160 mOhm/m. A value of about 76 dB was achieved at 10 MHz with the same plug connector, but additionally fitted with the two-part EMC frame as described above (see FIG. 6). This corresponds to a transfer impedance of 8 mOhm/m. The shielding has therefore been improved by a factor of 20.

The invention claimed is:

1. An EMC-protected industrial plug connector, comprising:

a base part having two sides;

a plug part having two sides and being configured to be mated with said base part;

said base part and said plug part each having a respective contact insert and a respective metallic housing;

a first metallic frame sheet formed of a low-impedance, conductive material disposed on said base part;

a second metallic frame sheet formed of a low-impedance, conductive material disposed on said plug part;

said contact inserts and said frame sheets configured to provide electromagnetic compatibility for the industrial plug connector;

said frame sheets being at least partially mutually overlapped in a mated state;

strips each mounted on a respective one of said two sides of a respective one of said base part and said plug part, said strips having holes formed therein;

screws disposed in said holes formed in said strips for screwing said base part to said plug part;

rivets respectively connecting said strips to said base part and to said plug part;

a housing wall; and a collar at least partially resting on an inner wall surface of said housing of said base part and producing an electrical contact between said housing wall and said housing of said base part in a final assembled state.

2. The industrial plug connector according to claim 1, wherein said low-impedance, conductive material is galvanized steel sheet.

3. The industrial plug connector according to claim 1, wherein said frame sheets are each screwed to a respective one of said contact inserts.

4. The industrial plug connector according to claim 1, wherein said first frame sheet projects out of said housing of said base part and is aligned with said contact insert of said base part.

5. The industrial plug connector according to claim 1, wherein said second frame sheet is disposed within said housing of said plug part and is aligned with said housing of said plug part.

6. The industrial plug connector according to claim 1, wherein said rivets each have a head, and spring elements are each disposed between a respective one of said rivet heads and one of said strips.

7. An industrial plug connector, comprising:

a base part;

a plug part configured to be mated with said base part;

said base part and said plug part each having a respective contact insert and a respective metallic housing;

a first metallic frame sheet disposed on said base part;

a second metallic frame sheet disposed on said plug part;

said frame sheets being at least partially mutually overlapped in a mated state;

a housing wall having a through-opening;

said base part being fixed to said housing wall and having a holding area for said contact insert of said base part;

said through-opening of said housing wall opening into said holding area of said base part;

another frame sheet to be adapted to said through-opening, said other frame sheet having a collar projecting into said through-opening; and said collar at least partially resting on an inner wall surface of said housing of said base part and producing an electrical contact between said housing wall and said housing of said base part in a final assembled state.

8. The industrial plug connector according to claim 7, wherein said other frame sheet has a mounting flange, and said collar projects out of said mounting flange and rests flush on an edge of said through-opening in the final assembled state.

9. The industrial plug connector according to claim 7, wherein said collar is formed of a multiplicity of sprung teeth disposed alongside one another and resting on said inner wall surface of said housing of said base part under spring pressure, in the final assembled state.

10. An industrial plug connector, comprising:

a housing wall having a through-opening;

a base part fixed to said housing wall, said base part having a housing with an inner wall surface, a contact insert and a holding area for said contact insert;

said through-opening of said housing wall opening into said holding area of said base part;

a frame sheet to be adapted to said through-opening, said frame sheet having a collar projecting into said through-opening; and said collar at least partially resting on said inner wall surface of said housing of said base part and producing an electrical contact between said housing wall and said housing of said base part in a final assembled state.

11. The industrial plug connector according to claim 10, wherein said frame sheet has a mounting flange, and said collar projects out of said mounting flange and rests flush on an edge of said through-opening in the final assembled state.

12. The industrial plug connector according to claim 10, wherein said collar is formed of a multiplicity of sprung teeth disposed alongside one another and resting on said inner wall surface of said housing of said base part under spring pressure, in the final assembled state.

* * * * *